US006032669A

United States Patent [19]

Klein

[11] Patent Number: 6,032,669

[45] Date of Patent: Mar. 7, 2000

[54] POSITIONING PILLOW FOR APPROXIMATING ANATOMIC POSITION IN LATERAL DECUBITUS POSITION

[76] Inventor: Jeffrey A. Klein, 30280 Rancho Viejo Rd., San Juan Capistrano, Calif. 92675

[21] Appl. No.: 08/870,468

[22] Filed: Jun. 6, 1997

Related U.S. Application Data

[63] Continuation-in-part of application No. 29/055,823, May 3, 1996.

[51] Int. Cl.[7] ..... A61G 15/00

[52] U.S. Cl. ..... 128/845; 128/882; 5/648; 5/650

[58] Field of Search ..... 128/845, 846, 128/877, 878, 879, 882; 602/13, 23, 24; 5/624, 644, 647, 648, 649, 650, 651

[56] References Cited

U.S. PATENT DOCUMENTS

| | | | |
|---|---|---|---|
| D. 254,029 | 1/1980 | Barbagallo | D24/36 |
| D. 359,804 | 6/1995 | Carter | D24/183 |
| 2,709,435 | 5/1955 | Kress | 5/648 |
| 3,946,451 | 3/1976 | Spann | 5/650 |
| 3,995,846 | 12/1976 | LaRooka Frick | 269/328 |
| 4,910,818 | 3/1990 | Grabill | 5/648 |
| 5,289,828 | 3/1994 | Toth | 5/648 |
| 5,477,866 | 12/1995 | Davenport | 128/845 |

*Primary Examiner*—Michael A. Brown
*Attorney, Agent, or Firm*—Stetina Brunda Garred & Brucker

[57] ABSTRACT

A surgical support for positioning a patient's lateral thighs during liposuction thereof. The support comprises an elongate pillow positionable between the thighs of the patient such that a respective one of the patient's lateral thighs is maintained in an upwardly-oriented position and abducted from the patients body such that the greater trochanter of the femur of such abducted leg is rotated interiorally and medially to such a degree that pseudobulging of the greater trochanter is eliminated or substantially minimized. The pillow preferably includes a tapered proximal end oriented to be positioned towards the crotch of the patient and a gradually upwardly-extending distal end that defines a top support surface upon which the lateral thigh is intra-operatively positioned. The support further is provide with a passageway formed therewithin and pillow along the length thereof to accommodate the respective other leg of the patient so that the patient may assume the lateral decubitus position while approximating the anatomic position.

8 Claims, 2 Drawing Sheets

Fig. 1
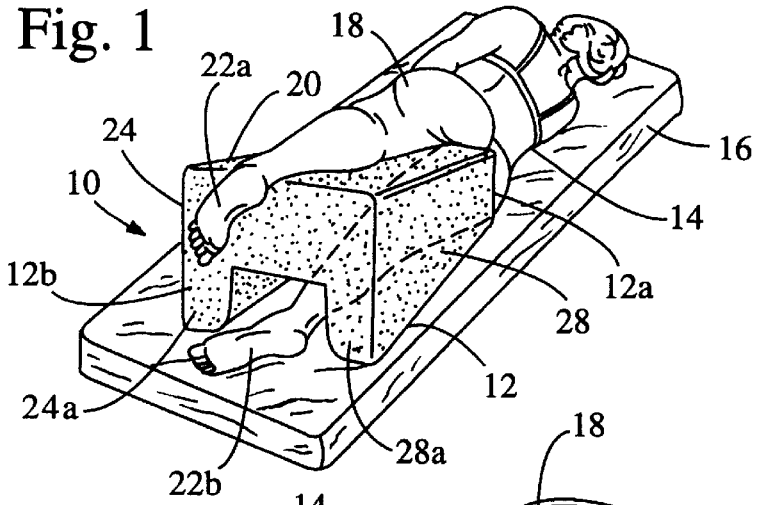
Fig. 2
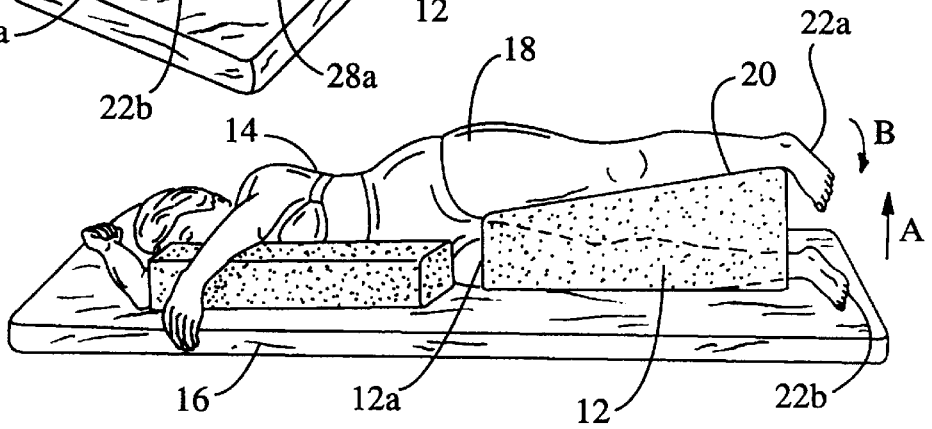
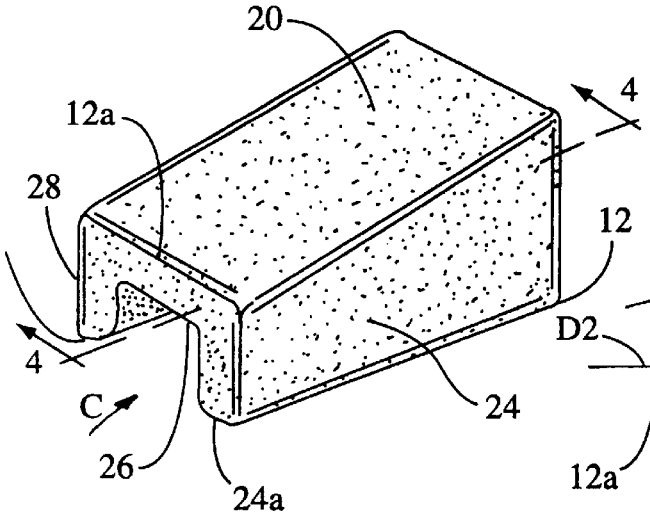
Fig. 3
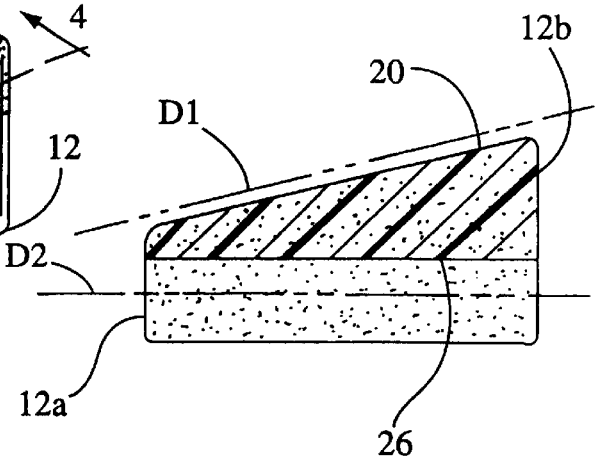
Fig. 4

POSITIONING PILLOW FOR APPROXIMATING ANATOMIC POSITION IN LATERAL DECUBITUS POSITION

RELATED APPLICATIONS

This is a continuation-in-part of co-pending Design application Ser. No. 29/055,823, May 3, 1996 the disclosure of which is expressly incorporated herein by reference.

FIELD OF THE INVENTION

The present invention relates to surgical support devices, and more particularly, support devices for positioning a patient's thighs during surgery.

BACKGROUND OF THE INVENTION

One of the most significant improvements made in the field of cosmetic surgery has been a new type of liposuction surgery, known as tumescent liposuction or the tumescent technique. The tumescent technique, invented by Dr. Jeffrey A. Klein, M.D. in 1985, uses a large volume of fluid that is infiltrated into a targeted fat compartment to produce swelling and firmness therein. The fluid generally comprises a very dilute epinephrine solution and a dilute anesthetic solution which cooperate to produce vasoconstriction and a profound anesthesia within the targeted fat compartment while further maintaining the fat in a tumescent state.

While the fat is maintained in this tumescent state, a microcannula is systematically inserted into the fat compartment in a series of elongate paths. The cannulas, which are connected to a suction device, extract the suspended fatty tissue in elongate, cylindrical portions which, as a result, create a network of many small tunnels running throughout the targeted fat compartment. Having selectively removed the fat from within the fat compartment, and thus forming the series of tunnels therein, the excess epinephrine/anesthetic solution is allowed to drain through the incisions through which the procedure is performed. Accordingly, over time the tunnels formed by the cannulas collapse, and ultimately cause the compartment to assume the desired contour.

The tumescent liposuction technique has been widely praised and has been written about extensively. Among the numerous articles disclosing the specifics of the tumescent liposuction technique include: Klein, M.D., Jeffrey Alan, *The Tumescent Technique: Anesthesia and Modified Liposuction Technique*, Dermatologic Clinics, Vol. 8, No. 3, July 1990; Klein, M.D., Jeffrey A., *The Tumescent Technique For Lipo-Suction Surgery*, Am. J. Cosmetic Surg., Vol. 4, No. 4, 1987; Klein, M.D., Jeffrey A., *Tumescent Technique For Regional Anesthesia Permits Lidocaine Doses of* 35 *mg/kg For Liposuction*, J. Dermatol. Surg. Oncol., 16:3, March 1990; Klein, M.D., Jeffrey A., *Tumescent Technique For Local Anesthesia Improves Safety In Large-Volume Liposuction*, Plastic and Reconstructive Surgery, Vol. 92, No. 6, November 1993; and Klein, M.D., Jeffrey A., *Anesthesia For Liposuction and Dermatolocic Surgery*, J. Dermatol. Surg. Oncol., 14:10, October 1988, the teachings of each being expressly incorporated herein by reference.

The tumescent liposuction technique advantageously allows for large amounts of fat to be removed from the body with virtually no blood loss. Additionally, the tumescent technique has further proven to be less painful, has minimized post-operative recovery time, and has produced optimal cosmetic results as compared to other liposuction procedures. Importantly, the tumescent technique, by using local anesthesia, advantageously avoids the need for intravenous sedatives, narcotic analgesics, or general anesthesia, all of which having greater risks associated therewith.

However, despite its advantages, tumescent liposuction surgery can produce significant aesthetic defects and patient dissatisfaction if improperly performed. Such risks are likely when the patient is improperly positioned during liposuction, and are especially likely during liposuction of the lateral thigh. In this regard, of all areas treated by liposuction, the lateral thigh is probably the most vulnerable to poor in intra-operative positioning.

With respect to liposuction of the lateral thighs, such improper intra-operative positioning may form a topical distortion of the thigh's subcutaneous fat compartments, known as a lipowarp. One special type of lipowarp, which is frequently encountered during liposuction of the lateral thigh, known as the trochanteric pseudobulge, occurs during adduction of the thigh. Such adduction causes the greater trochanter of the femur to protrude outwardly, thus elevating and distorting the overlying fat and creating a "pseudobulge". The greater the degree of thigh adduction, the greater the size of the pseudobulge, which is maximized when an individual assumes a lateral decubitus high-step position, namely, when the hip is flexed forward and the thigh adducted. As is known, when doing liposuction with a pseudobulge, there is a tendency to overcompensate and remove too much fat, thereby creating a trochanteric lipotroph (i.e., a discrete depression of skin of the trochanter caused by localized excessive liposuction).

Current intra-operative positioning for liposuction of the lateral thighs, however, presently fails to adequately address the problem created by the outward protrusion, or pseudobulging of the greater trochanter. In this regard, the supine and prone position presents both a warped target and an awkward access for the surgeon. Likewise, the weight of the patient's body compresses the targeted fat compartment in the anterior-posterior direction and simultaneously causes and accentuates the pseudobulge. The lateral decubitus position likewise has drawbacks insofar as in such position, the patient's upper-most thigh is slightly adducted, which thus accentuates the pseudobulge.

Ideally, the optimal position for liposuction of the lateral thighs is a modified lateral decubitus position that approximates the anatomic position. In this regard, with the patient recumbent on a surgical table, the anatomic position minimizes the distortion of fatty tissues caused by altered position of subjacent musculoskeletal structures. Additionally, a patient's pre-operative shape is usually assessed with the patient standing in the anatomic position and, as such, by utilizing an intraoperative position that approximates the anatomic position, the nuances and subtleties of pre-operative shape will be more easily discerned intra-operatively. Furthermore, it is widely recognized that patients usually judge the result of their surgery while standing erect in front of a mirror in a manner that approximates the anatomic position. When surgery is done in the same position as pre- and post-operative assessment, it is more likely that the patient will be pleased with the result of the liposuction once the post-operative inflammation and swelling have subsided. Unfortunately, however, at the present time the present art is deficient in providing any support apparatus or methods that help approximate the anatomic position when the patient assumes a lateral decubitus position.

Accordingly, there in a need in the art for a surgical support device that eliminates or substantially minimizes the trochanteric pseudobulge during liposuction surgery. There is additionally a need in the art for such a device that enables a patient to approximate the anatomic position while the patient assumes a lateral decubitus position. The art is further deficient in providing a surgical support device for positioning a respective one of a patient's thighs that is effective, easy to use, inexpensive to manufacture, and of simple construction.

SUMMARY OF THE INVENTION

The present invention specifically addresses and alleviates the aforementioned deficiencies in the art. Specifically, the present invention is directed to a surgical support for positioning a respective one of a patient's lateral thighs during liposuction surgery. The support comprises an elongate pillow having proximal and distal ends and a top support surface that, in use, is positioned between the legs of the patient while the patient assumes a lateral decubitus position. The pillow supports, on the top support surface thereof, a respective one of the patient's lateral thighs such that the thigh is maintained in an upwardly-oriented position and abducted from the patient's body such that the greater trochanter of the femur of such abducted leg is rotated interiorally and medially to such a degree that pseudobulging of the greater trochanter is eliminated or otherwise substantially minimized.

Preferably, the pillow is formed to have a generally wedge-like shape, with the proximal end of the pillow being generally tapered and oriented to be positioned towards the crotch of the patient and the distal end being oriented towards the feet of the patient. The top support surface of the pillow is further formed to extend upwardly along a diagonal axis. To provide for maximum interior and medial rotation of the trochanter, the pillow is preferably lengthened such that the pillow extends from the crotch of the patient to approximately the ankle of the leg of the upwardly-oriented abducted lateral thigh such that the knee and ankle of such leg rotate medially, thus causing the toes of that foot to assume a "pigeon-toed" position.

The surgical support is further preferably provided with a passageway formed at the base thereof to allow the respective other leg of the patient to extend therethrough while the patient assumes a lateral decubitus position. The passageway formed through the base of the support is preferably formed along a horizontal axis relative the patient's body to thus ensure that the upwardly-oriented thigh is maintained in an abducted state relative the body of the patient.

It is therefore an object of the present invention to provide a surgical support for positioning a respective one of a patient's lateral thighs that helps the patient assume the anatomical position when the patient assumes a lateral decubitus position.

Another object of the present invention is to provide a surgical support for positioning a respective one of a patient's lateral thighs such that the greater trochanter of the femur of the positioned thigh is rotated interiorally and medially so that the presence of a trochanteric pseudobulge is eliminated or substantially minimized.

Another object of the present invention is to provide a surgical support for positioning a respective one of a patient's lateral thighs when the patient assumes a lateral decubitus position that further enables the knee and ankle of the leg of the positioned thigh to rotate medially such that the femur of the positioned thigh may rotate interiorally and medially.

Another object of the present invention is to provide a surgical support for positioning a respective one of a patient's thighs when the patient assumes a lateral decubitus position that accommodates the respective other leg of the individual and allows the same to assume a fully extended position while the patient maintains the lateral decubitus position.

A still further object of the present invention is to provide a surgical support for positioning a respective one of a patient's lateral thighs while the patient assumes a lateral decubitus position that may be easily and readily utilized, of simple construction, and inexpensive to manufacture.

BRIEF DESCRIPTION OF THE DRAWINGS

These, as well as other features of the present invention, will become more apparent upon reference to the drawings, wherein:

FIG. 1 is a perspective view of a patient assuming a lateral decubitus position upon an operating table having interposed between the legs thereof a surgical support according to a preferred embodiment of the present invention;

FIG. 2 is a side perspective view of the patient and surgical supports depicted in FIG. 1;

FIG. 3 is a perspective view of the surgical support of the present invention;

FIG. 4 is a cross-sectional view taken along line 4—4 of FIG. 3;

DETAILED DESCRIPTION OF THE PREFERRED EMBODIMENT

The detailed description set forth below in connection with the appended drawings is intended merely as a description of the presently preferred embodiment of the invention, and is not intended to represent the only form in which the present invention may be constructed or utilized. The description sets forth the functions and sequence of steps for construction and implementation of the invention in connection with the illustrated embodiments. It is to be understood, however, that the same or equivalent functions and sequences may be accomplished by different embodiment that are also intended to be encompassed within the spirit and scope of the invention.

Figure 5:
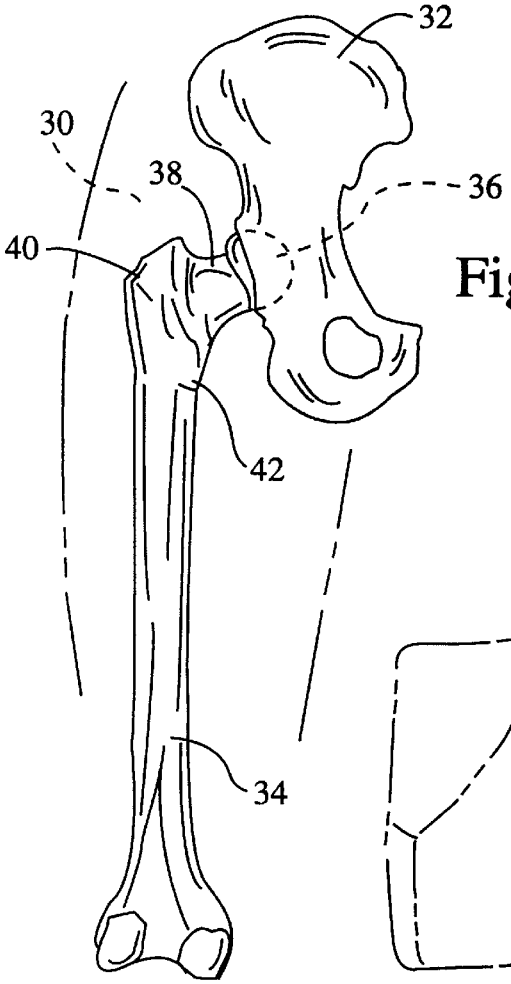
FIG. 5 is a frontal view of an interconnected human hip bone and femur.
Figure 6A:
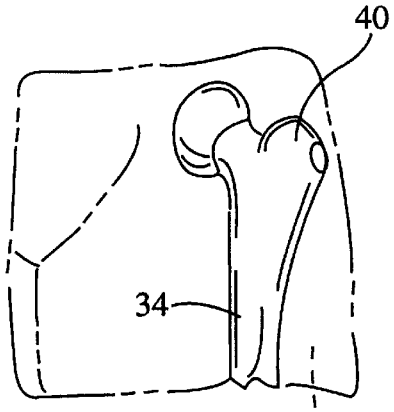
FIG. 6*a* is a frontal view of a portion of a femur and the greater trochanter thereof of a human being.
Figure 6B:
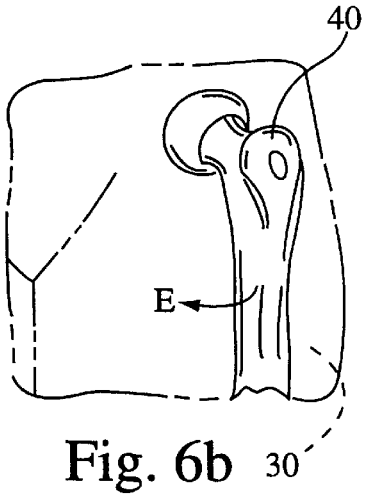
FIG. 6*b* is a frontal view of the femur and greater trochanter of 6*a* being rotated interiorally and medially.
Figure 6C:
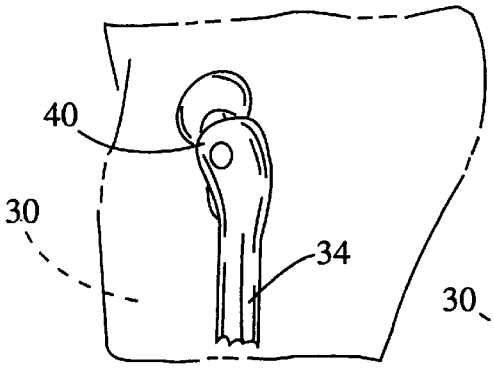
FIG. 6*c* is a side view of a portion of a femur and the greater trochanter thereof of a human being.
Figure 6D:
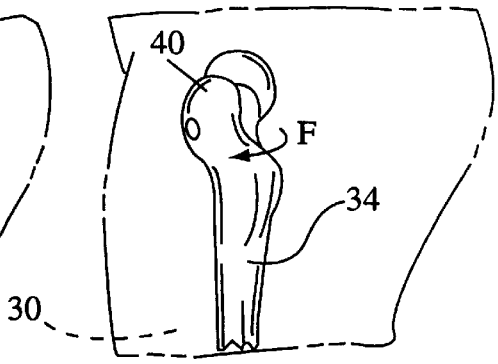
FIG. 6*d* is a side view of the femur and greater trochanter of 6*c* being rotated interiorally and medially.

To understand and appreciate the scope of the present invention, reference is initially made to FIGS. 5–6*d* and particularly to FIG. 5, where there is shown the hip bone 32 and femur 34 and related anatomical structures formed thereon as shown within the thigh 30 of an individual. Normally, the head of the femur 36 is in acetabulum with the hip bone 32. Extending from the head of the femur 36 is neck portion 38 about which are formed the greater trochanter 40 and lesser trochanter 42. As is well-known, adduction of the thigh causes the greater trochanter 40 to protrude outwardly, thereby elevating and distorting the fat overlying thereabout and creating a "pseudobulge". The greater the degree of thigh adduction, the greater the size of the trochanteric pseudobulge.

The presence of a trochanteric pseudobulge during liposuction of the lateral thighs, however, is undesirable insofar as the surgeon performing a liposuction procedure has a tendency to overcompensate and remove too much fat, thereby creating a trochanteric lipotroph. As such, it is desirable when performing liposuction of the lateral thighs that the effect produced by a trochanteric pseudobulge be eliminated or substantially minimized. To this end, the trochanteric pseudobulge may be easily and readily eliminated by abducting a respective thigh, and immediately rotating the knee and ankle into an exaggerated "pigeon-toed" position. Such motion, as depicted as E in frontal views 6*a* and 6*b* and as F in side views 6*c* and 6*d*, causes the greater trochanter 40 to rotate interiorly and medially. As a result, the trochanter 40 assumes a position that minimizes the distortion of fatty tissues and most approximates the anatomic position, which thus approximates the optimal intra-operative position for liposuction of the lateral thighs.

Referring now to the remaining drawings, and initially to FIG. 1, there is shown a liposuction patient positioning support 10 according to a preferred embodiment of the present invention that is specifically designed to eliminate or substantially minimize trochanteric pseudobulging during liposuction of the lateral thighs. As illustrated, the support 10 comprises a unique wedge-shaped surgical pillow 12 for abducting the uppermost thigh 18 of a respective one of the patient's 14 thighs when the patient 14 assumes a lateral decubitus position upon an operating table 16. The pillow 12 further preferably includes a tapered proximal end 12*a* designed to be oriented towards the crotch of the patient 14, and a distal end 12*b* oriented towards the feet 22*a*, 22*b* of the patient 14 while the patient 14 is maintained in the lateral decubitus position. To accommodate the lowermost leg of the patient 14, there is provided support members 24*a* and 28*a* that define a passageway, depicted by the letter C in FIG. 3, through which such leg and foot of the patient may extend.

To help the patient 14 approximate the anatomic position, and thus eliminate or substantially minimize the presence of a trochanteric pseudobulge in the uppermost thigh 18, the pillow 12 is provided with a top support surface 20 that is angled upwardly such that the uppermost thigh 18 is abducted or moved away from the body, as indicated in the direction A depicted in FIG. 2. As further illustrated, the pillow 12 will further be preferably formed to have a length such that the pillow 12 extends from the crotch of the individual to the ankle of the uppermost leg of the patient 14. By being so sized, the uppermost foot 22*a* of the patient will rotate inwardly, as indicated by the letter B, such that the toes of that foot 22*a* will point in a "pigeon-toed" fashion.

As more clearly seen in FIG. 3, the pillow 12 is designed such that the proximal end 12*a* thereof is tapered and oriented to be interposed between the legs of the individual undergoing surgery while said individual assumes a lateral decubitus position. As illustrated, support members 24*a*, 28*a*, which extend downwardly from sidewalls 24, 28, respectively, and ceiling 26 define a passageway C at the base of the pillow 12 through which the lower leg and foot of the patient may extend.

As discussed above, top support surface 20 extends diagonally upward from the proximal end 12*a* of the pillow 12 to the distal end 12*b* thereof to provide means for abducting the uppermost thigh and leg of the patient. More specifically, as illustrated in FIG. 4, the top support surface 20 will extend diagonally upward along axis D1 from the proximal end 12*a* to the distal end 12*b* of the pillow 12 with the passageway formed within the pillow 12 being formed along axis D2 that that is parallel to the surgical table upon which the surgery is performed. By forming the pillow 12 in such a manner, the thighs of the patient approximate the anatomic position while the patient is maintained in a lateral decubitus position. Additionally, such construction ideally separates and isolates the upper and lower legs from one another such that the uppermost thigh will be maintained in an abducted state throughout the duration of the surgery until the surgical pillow 12 is withdrawn.

With respect to proper usage of the surgical support of the present invention, the patient, at the outset, should assume the lateral decubitus position, with both legs extending straight forward. With the knee of the targeted thigh straight (i.e., the upwardly-oriented thigh to be abducted), the leg of such thigh is lifted and the surgical support pillow 12 interposed between the thighs such that the proximal end 12*a* is oriented towards the crotch of the individual, and the distal end 12*b* thereof being oriented towards the feet and ankles of the patient, as depicted in FIGS. 1 and 2. The liposuction procedure may then be performed upon the lateral thigh using conventional methods. Thereafter, the pillow 12 may be removed and the patient allowed to recover post-operatively.

Although the invention has been described herein with specific reference to a presently preferred embodiment thereof, it will be appreciated by those skilled in the art that various additions, modifications, deletions and alterations may be made to such preferred embodiment without departing from the spirit and scope of the invention. Accordingly, it is intended that all reasonably foreseeable additions, modifications, deletions and alterations be included within the scope of the invention as defined in the following claims.

What is claimed is:

1. A surgical support for positioning a respective one of a patient's lateral thighs when said patient assumes a lateral decubitus position comprising:

a) an elongate pillow having proximal and distal ends, a top support surface having a generally tapered proximal end configured and oriented to be positioned toward the crotch of said patient and a gradually widened distal end configured and oriented to be positioned toward the feet of said patient, and passageway directly below said top surface, said passageway defining a tunnel for accommodating a thigh and leg, said tunnel being sized to substantially extend over said thigh and leg extending therethrough, said pillow being positionable between the thighs of said patient when in a lateral decubitus position such that one of said patient's lateral thighs is in said passageway and the other of said patient's thighs is maintained substantially directly thereabove in an upwardly-oriented position upon said top support surface and abducted sufficiently away from the patient such that the greater trochanter of the femur of said upwardly-oriented lateral thigh is rotated anteriorly and medially to such a degree that pseudobulging of the greater trochanter of said femur is substantially minimized.

2. The surgical support of claim 1 wherein said top support surface is formed to have a generally tapered proximal end configured and oriented to be positioned toward the crotch of said patient and a gradually widened distal end configured and oriented to be positioned toward the feet of said patient.

3. The surgical support of claim 2 wherein said pillow assumes a generally wedge-like shape such that said top support surface extends along an upwardly-extending diagonal axis relative said patient.

4. The surgical support of claim 2 wherein said pillow is formed to have a length such that when said pillow is positioned between said thighs of said patient, said pillow extends from said crotch of said patient to approximately the ankles thereof.

5. The surgical support of claim 4 wherein said top support surface of said pillow extends diagonally upward to a height sufficient such that the knee and the ankle of the leg of said upwardly-oriented thigh are caused to rotate medially.

6. The surgical support of claim 5 wherein said top support surface of said pillow is designed and configured to cause said knee and said ankle of the legs of said upwardly-oriented thigh to sufficiently medially rotate such that the pointing toes of the foot of the leg of said upwardly-oriented thigh assume a pigeon-toed position.

7. The surgical support of claim 1 wherein said passageway is defined by two downwardly-extending sidewalls formed on said top support surface and a longitudinally extending ceiling formed within said pillow along the length thereof.

8. The surgical support of claim 7 wherein said passageway formed within said pillow extends along a horizontal axis relative said patient when said patient assumes said lateral decubitus position.

* * * * *